US006412770B1

(12) United States Patent
Demmeler

(10) Patent No.: US 6,412,770 B1
(45) Date of Patent: Jul. 2, 2002

(54) DEVICE AND METHOD FOR INDIVIDUALLY SEPARATING A PILE OF SHEETLIKE DATA RECORDING MEDIA

(75) Inventor: Erwin Demmeler, Memmingen (DE)

(73) Assignee: Giesecke & Devrient GmbH, Munich (DE)

( * ) Notice: Subject to any disclaimer, the term of this patent is extended or adjusted under 35 U.S.C. 154(b) by 0 days.

(21) Appl. No.: 09/674,503

(22) PCT Filed: May 11, 1999

(86) PCT No.: PCT/EP99/03238

§ 371 (c)(1),
(2), (4) Date: Dec. 28, 2000

(87) PCT Pub. No.: WO99/59906

PCT Pub. Date: Nov. 25, 1999

(30) Foreign Application Priority Data

May 15, 1998 (DE) ..... 198 21 871

(51) Int. Cl.[7] ..... B65H 3/12

(52) U.S. Cl. ..... 271/94; 271/104; 271/105; 271/35; 271/124

(58) Field of Search ..... 271/94, 95, 96, 271/104, 105, 35, 126, 127, 124, 118

(56) References Cited

U.S. PATENT DOCUMENTS 3,424,453 A * 1/1969 Hilbert ..... 271/35
3,612,512 A 10/1971 Lang
4,961,566 A * 10/1990 Labombarde et al. ..... 271/35
5,074,539 A * 12/1991 Wells et al. ..... 271/35
5,244,197 A 9/1993 Helmstädter
5,423,527 A * 6/1995 Tranquilla ..... 271/270
5,513,773 A 5/1996 Cargill
6,164,432 A * 12/2000 Monsees ..... 271/35

FOREIGN PATENT DOCUMENTS

| | | |
|---|---|---|
| DE | 1 267 012 | 4/1968 |
| DE | 25 47 248 | 6/1976 |
| EP | 0 267 665 | 5/1988 |
| GB | 1 234 629 | 6/1971 |
| GB | 1 245 640 | 9/1971 |
| GB | 2 092 556 | 9/1982 |
| GB | 2 150 122 | 6/1985 |

* cited by examiner

*Primary Examiner*—H. Grant Skaggs
(74) *Attorney, Agent, or Firm*—Bacon & Thomas, PLLC

(57) ABSTRACT

An apparatus for singling sheetlike data carriers is proposed wherein the stack (30) to be singled is located on a rest (5) which is movable relative to a feed device (4) in clocked fashion such that individual data carriers are moved in the direction of a singling gap whose width is variable by a retaining element (13) in synchronism with the clocked motion of the rest (5). This apparatus is able to attain a high throughput even with different sheet qualities while guaranteeing high functional safety.

21 Claims, 4 Drawing Sheets

Figure 1:
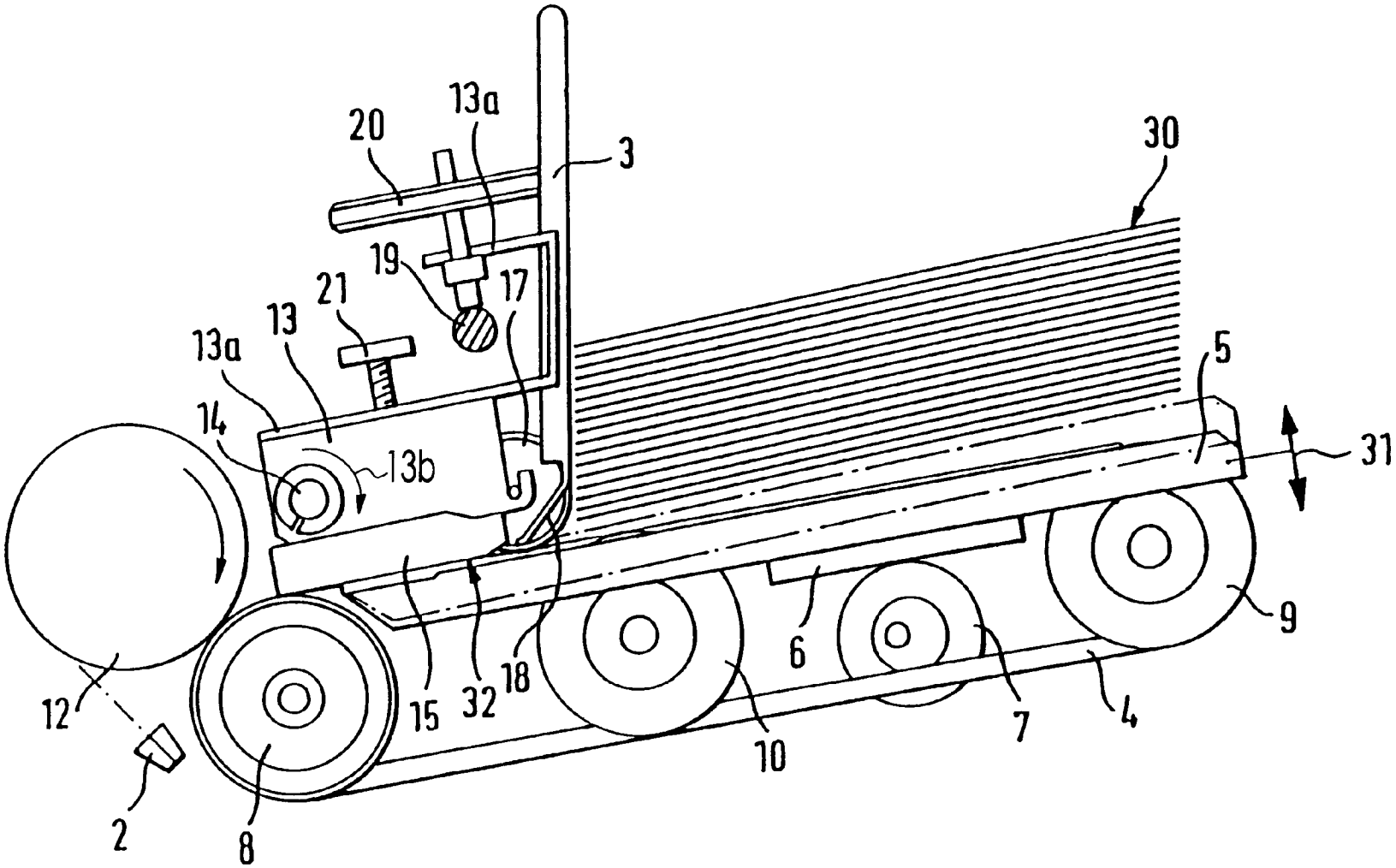

DEVICE AND METHOD FOR INDIVIDUALLY SEPARATING A PILE OF SHEETLIKE DATA RECORDING MEDIA

This invention relates to an apparatus and method for singling a stack of sheet-like data carriers.

Such apparatuses and methods are used inter alia in bank note processing machines to deliver individual notes of a stack to a transport system which conveys the notes to testing, sorting and stacking devices for further processing. The throughput of a bank note processor is determined quite crucially by the power of the singler.

EP 0 535 467 B1 discloses a singling apparatus for paper sheets wherein the stack rests on a lifting device movable up and down between conveyer belts. Up and down motion of the lifting device causes presingling rolls, which are elastically biased, to be raised off or lowered onto the conveyer belts jointly with the leading portion of the stack grasped by said rolls. The singling gap is adjusted firmly between a feed roll and a fixed singling roll, the singling roll being supposed to retain the following sheets located on the paper sheet to be singled.

Although the known singling apparatus permits individual sheets to be removed from a stack due to the clocked up and down motion of the lifting device, in particular with constant paper quality, and optionally also produces gaps between individual sheets if the lifting device is driven accordingly, the known singling apparatus reaches its limits at high singling speeds and/or with different sheet qualities when disturbances occur, e.g. double picks or clogging of the singling gap. Since the singling gap is adjusted to a sheet thickness, very strong pressure in the singling gap already arises when a sheet with a folded-in leading edge is fed, which can lead to a disturbance, for example clogging of the singling gap. But even if such a folded-in sheet passes the singling gap, the load on said sheet is very strong so that the sheet can be damaged, e.g. dog-ears torn off or the like.

The invention is therefore based on the problem of providing an apparatus for singling sheetlike data carriers which also works with different sheet qualities of the data carriers at high throughput and with high fictional safety. The data carriers should also be singled in an especially gentle way.

This problem is solved by the features of the main claim.

The inventive solution involves clocked interruption of the action of a feed device on the stack and, in synchronism with this process, a change in the width of the singling gap. In addition to said change of the singling gap, the retaining force on the next data carrier to be singled is influenced. The inventive solution permits very high throughputs to be reached without disturbances by jammed data carriers even if the stack contains data carriers of very different quality (e.g. roughness, limpness, thickness, etc.). The invention also permits the gaps between successively singled data carriers to be especially exactly adjusted and maintained even at different lengths. Further, the retaining force on the data carriers can be very finely adjusted, thereby achieving optimal gentleness for the data carriers.

Figure 2A:
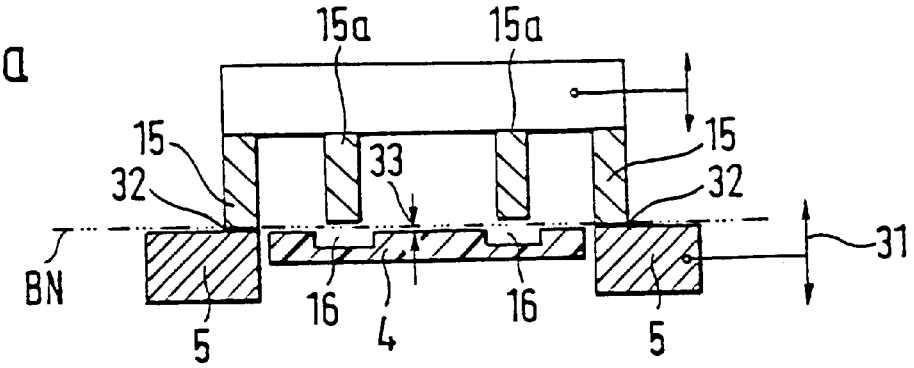
Figure 2B:
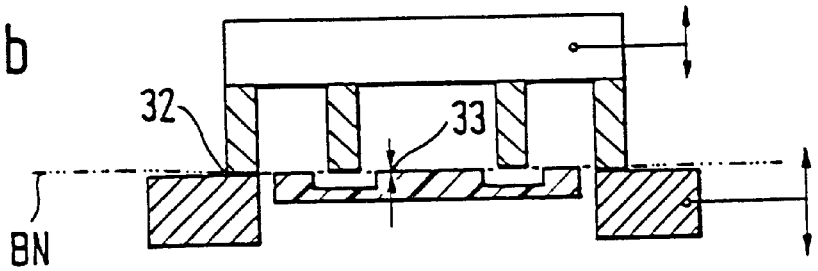
Figure 2C:
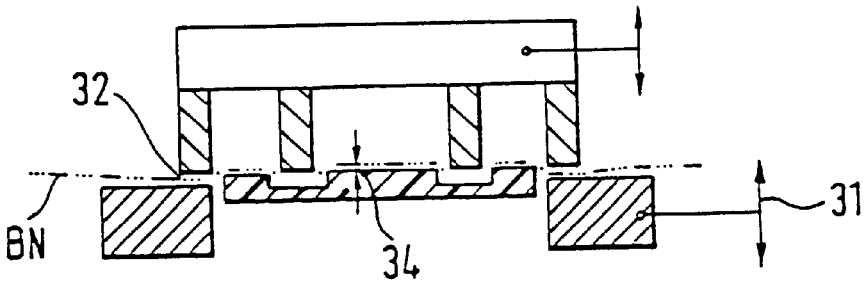
Figure 2D:
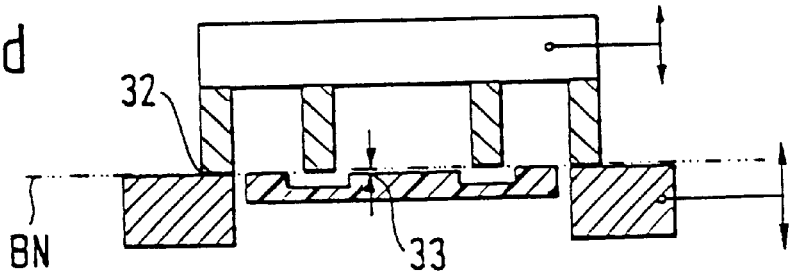
Figure 3:
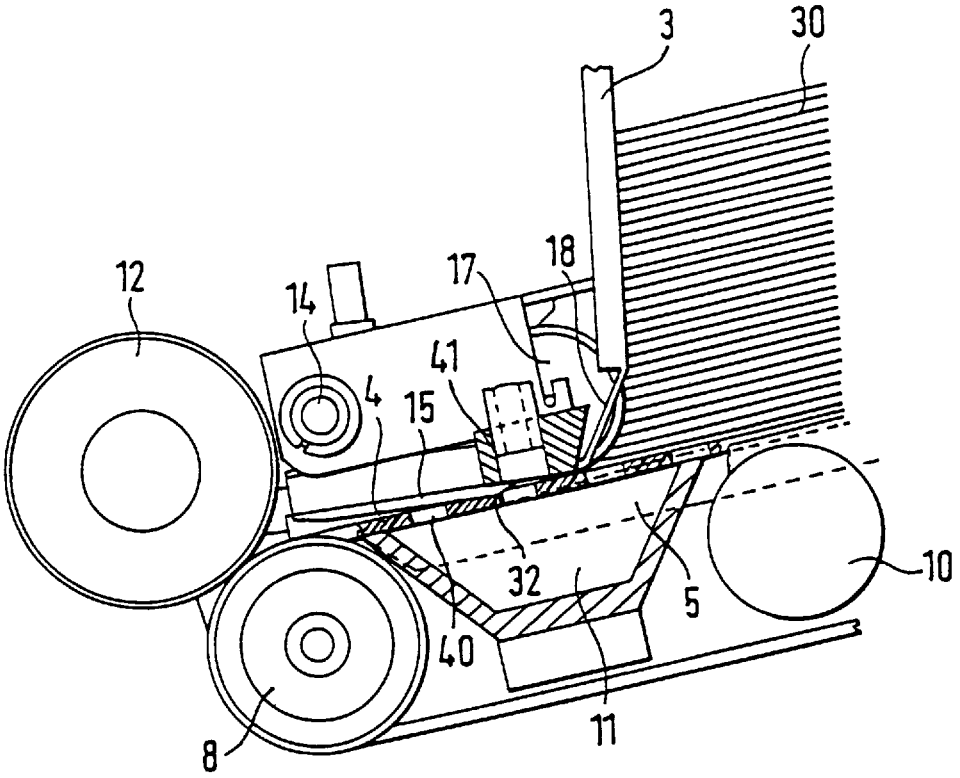
Figure 4:
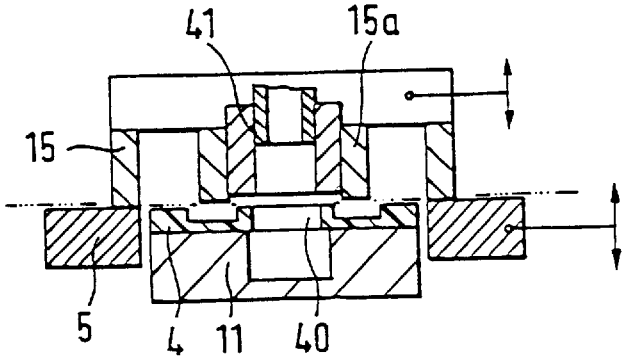
Figure 5:
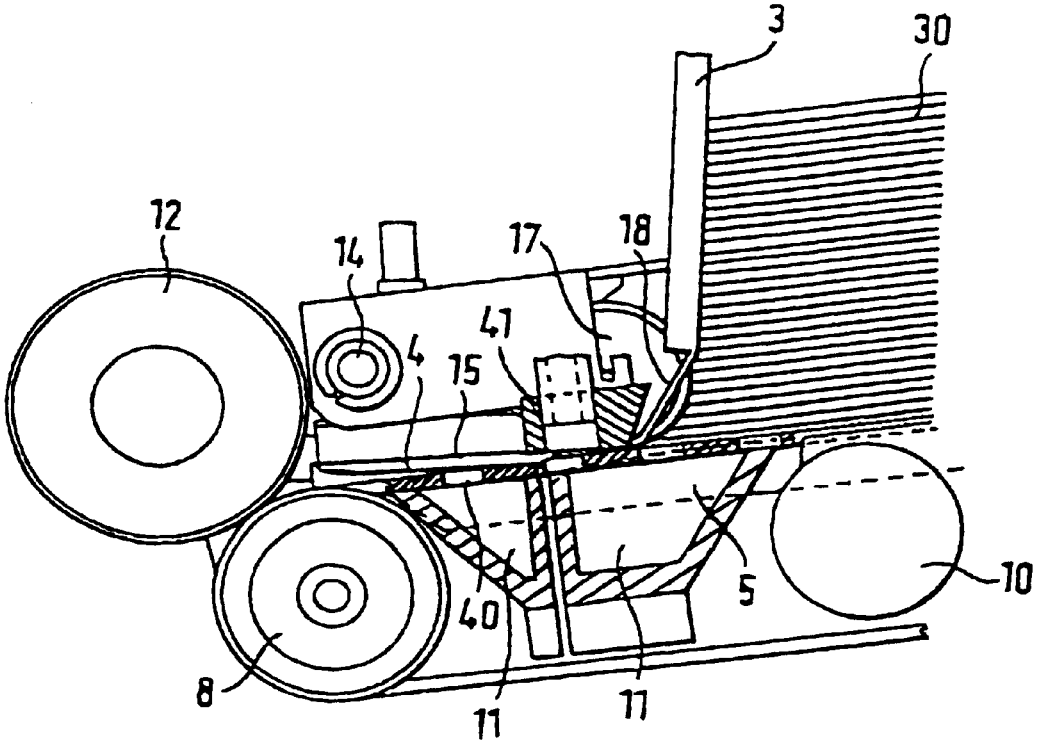

Further advantageous features and the functioning and structure of the invention will result from the following description of an example for singling bank notes with reference to the drawing, in which:

FIG. 1 shows a side view of the singling apparatus,

FIGS. 2*a–d* show views of the singling gap in four different operating conditions, FIG. 3 shows a further example in a side view, FIG. 4 shows a sectional view of the example according to FIG. 3, and FIG. 5 shows another further example in a side view.

FIG. 1 shows a singling apparatus for bank note stacks 30 which are inserted into an input pocket not shown in detail. The short sides of the notes pointing in the singling direction are aligned therein with bank note stop face 3. The input pocket is limited downward by the upper run of conveyer belt 4 and the rest executed as rocker rest 5. Rocker rest 5 is executed in the form of two strip-shaped members fastened to common holder 6 and each extending on one side of conveyer belt 4 parallel thereto. Associated with holder 6 is rotatingly drivable cam disk 7 which controls the lifting motion of rocker rest 5.

Conveyer belt 4 extends between drive roll 8 and deflection roll 9 and is acted upon by support roll 10 roughly below bank note stop face 3. Above drive roll 8 there is first transport roll 12 of a transport system following the singling apparatus so that an incoming bank note can be clamped and transported between transport roll 12 and freely rotating rolls disposed laterally of drive roll 8.

Above the upper run of conveyer belt 4, roughly between drive roll 8 and support roll 10, retaining device 13 is pivotally mounted around swivel axle 14. Fastened to the lower side of retaining device 13 are altogether four retaining runners 15 aligned with rocker rest 5 or conveyer belt 4. As indicated by FIG. 2, the two outer runners 15 are provided above rocker rest 5 while the two middle runners 15*a* are aligned with corresponding grooves 16 extending in the longitudinal direction of belt 4. Grooves 16 and retaining runners 15 have a rectangular cross section.

Altogether three pressure rolls 17 are disposed between retaining runners 15 and the input pocket, rolling on the three conveyer belt portions located beside the two grooves 16. Guide strips 18 extend between pressure rolls 17 and laterally thereof, being formed as extensions of bank note stop face 3 connected with retaining device 13. The guide strips extend at an angle of about 45° to stop face 3 or are provided with a corresponding radius, their ends facing conveyer belt 4 being aligned in the direction of retaining runners 15.

Pressure rolls 17 are fastened to a common rotation axle mounted so as to be freely rotatable and vertically displaceable in an oblong hole in retaining device 13.

The retaining device is supported on rocker rest 5 by reason of its own weight and/or a biasing element as shown by arrow 13*b*. Alternatively, a direct coupling of retaining device 13 and rocker rest 5 is also possible. The swivel motion directed toward conveyer belt 4 is limited by stop 19 which can be adjusted by adjusting wheel 20 and shackle 13*a* of retaining device 13 and thus adapted to note quality. Adjusting wheel 20 protrudes through a window in note stop face 3 so that it is always accessible without any great effort. To permit adjustment or readjustment of the position of runners 15 in the vertical direction they can be acted upon by adjusting screw 21.

Indicated by double arrow 31 and the broken-line view of rocker rest 5, FIG. 1 shows the lifting motion of rest 5. The rest is shifted during lifting motion such that bank note stack 30 is lifted off belt 4 first with the end facing away from the retaining device and redeposited on belt 4 first with the end facing the retaining device. This ensures that the lowermost sheet is always pulled and not pushed. This can be done either by a swivel motion of rest 5, as shown, or by a strict lifting motion, rest 5 being aligned at an angle of a few degrees relative to the upper run of belt 4.

In both cases the motion of rocker rest 5 raises or lowers the retaining device resting on rest 5 at clamping point 32 via the two outer retaining runners 15. Retaining device 13 is thereby swiveled around swivel axle 14, which also produces by means of bank note stop face 3 a shaking motion having a positive effect on the alignment of the bank notes.

The mode of functioning of the singling apparatus will be explained more closely in the following with reference to FIG. 2, FIG. 2*a* showing the phase in which rocker rest 5 is maximally lifted off conveyer belt 4. The singling gap, formed by retaining runners 15*a* and corresponding grooves 16 of conveyer belt 4, is maximally opened at this time and the clamping force at clamping points 32 between retaining runners 15 and rocker rest 5 is maximal. This singling phase corresponds to the position of the rocker rest in the dashed view of FIG. 1.

Bank note stack 30 is lifted off conveyer belt 4 at this time, and between the upper side of conveyer belt 4 and the lower edge of retaining runners 15*a* there is gap 33 of about one bank note thickness, i.e. about 0.1 to 0.2 mm. From this position rocker rest 5 is now lowered so that first, as shown in FIG. 2*b*, the lower side of retaining runners 15*a* and the surface of conveyer belt 4 are located on a common plane, i.e. the singling gap is closed, but there is not yet any meshing between conveyer belt and retaining runners. Distance 33 thus corresponds to 0 mm and at clamping point 32 there is contact between runners 15 and rest 5 but no appreciable clamping forces arise at clamping point 32 due to the elasticity of rest 5. The lowering of rocker rest 5 into the middle position causes lowermost bank note BN of stack 30 to come in contact with permanently circulating conveyer belt 4 and move in the direction of the singling gap. The note can be pushed into the singling gap despite retaining runners 15 resting on rocker rest 5 due to the action of conveyer belt 4 since the retaining runners have an aperture angle relative to the upper run of conveyer belt 4 and rocker rest 5. The next bank note is drawn along a piece due to the friction between the two bank notes, but retained by runners 15, 15*a*.

FIG. 2*c* shows the operating condition in which rocker rest 5 is lowered maximally and retaining device 13 lies against stop 19 so that a free gap arises between the rocker rest and retaining runners 15. At this time the two inner retaining runners 15*a* have already moved into groove 16 of conveyer belt 4; this meshing 34 is somewhat more than one bank note thickness, i.e. about 0.2 mm.

At this time the next bank note is standing with its leading edge at the singling gap, i.e. at retaining runners 15; the lowermost note already located in the singling gap is moved further by conveyer belt 4 until it is grasped by transport roll 12 which is then available for further transport.

Rocker rest 5 is raised out of this position again, the next note is lifted off conveyer belt 4, thereby preventing pushing from behind in the direction of the singling gap which would be undesirable at this time. While rocker rest 5 is lifted in the upward direction through the middle position shown in FIG. 2*d*, which corresponds to view 2*b* again, until it reaches a position according to FIG. 2*a*, the trailing end of first bank note BN to be singled is still located in the singling gap so that it is increasingly loaded by the clamping force between rocker rest 5 and retaining runners 15, but is pulled out of the singling gap by the following transport system. This causes tensile forces to be applied to said bank note, which smooth it. Simultaneously, this clamping at clamping point 32, which has its maximum value at this time, causes the next bank note to be singled to be retained at the singling gap. This produces a desired gap between two bank notes.

From the position shown in FIG. 2*a* the method shown above is now repeated so that the second bank note is transported into the singling gap while the third bank note is held back and at a distance, as described above.

During this process, pressure roll 17 rotating through the bank note motion together with guide strips 18 causes individual notes to fan out and the note to be singled to be pressed onto conveyer belt 4. This function is especially important in particular with the last note of a stack, i.e. when there is no pressing force from the weight of the stack. In conjunction with guide strips 18 there is also a preprofiling of the note, which favors its feed into the singling gap (incipient meshing).

Since the next bank note to be singled is still retained during the upward motion of rocker rest 5, it is also possible to single bank notes of different lengths out of a common stack and nevertheless produce a gap, whose length is then dependent on the bank note length. The retaining of the next bank note is then caused as of the condition shown in FIG. 2*d* (middle position) by the now increasing clamping force at clamping point 32. This retaining effect is of course favored by the fact that the action of conveyer belt 4 is reduced during the upward motion of rocker rest 5.

By accordingly controlling the motion of rocker rest 5 one can directly influence the length of the gap between two bank notes. If cam disk 7 runs in synchronism with the conveyer belt for example, the gap is only dependent on the length of the particular adjacent bank notes. When a stack of equally long bank notes is singled, constant gaps then arise.

It is also possible to detect the trailing edge of the last singled bank note by means of corresponding sensor 2 directly behind the singling apparatus and to drive rocker rest 5 such that equally great gaps are always produced between the individual notes even with differently long consecutive notes (mixed depositions).

During the singling process the frictional forces between the lowermost bank note and conveyer belt 4 must be greater than the frictional forces between the first and second bank notes. In order to obtain maximum adhesion between bank note and conveyer belt, conveyer belt 4 is provided in a further embodiment of the invention with two portions uniformly distributed along the circumference and each having a hole pattern which cooperate with suction box 11, disposed between drive roll 8 and support roll 10, over which conveyer belt 4 runs and which has a connection (not shown) with a vacuum source. Shortly after the transport of the first bank note has begun after action by conveyer belt 4, one of the perforated areas of the belt lies against the area of the leading edge of the bank note and increases adhesion between belt 4 and the lowermost note during passage over suction box 11. The length of the conveyer belt or the distance between the two hole patterns is selected such that two bank notes are singled during one complete circulation.

FIG. 3 shows the further embodiment and one of the two hole patterns with individual holes 40 in a position above suction box 11.

In a further embodiment of the invention as shown in FIG. 5, it is provided that the vacuum in suction box 11 is controllable by a valve unit for example. In contrast to the above-described embodiment the conveyer belt then has no partial perforation but one distributed continuously over the total belt length. Connecting the vacuum then permits the bank note to be subjected to the vacuum for different lengths of time coordinated with the particular bank note length. This permits selective control of the action of the conveyer belt on the lowermost bank note. By corresponding vacuum control in suction box 11 one can also influence the gap between two consecutively singled bank notes.

A further advantage of this embodiment is that, in contrast to the partly perforated belt where wear always takes place in the area of the hole pattern, uniform wear arises over the total circumference of the belt, resulting in especially long service life of a conveyer belt.

The arrangement of two suction chambers, one suction chamber disposed before the singling gap in the transport direction and the other suction chamber behind the singling gap, makes it possible to act upon said two suction chambers with a time overlap, successively. The suction force supporting transport can thus be exerted on the bank note just being singled as long as possible during its motion through the narrow singling gap, without the bank note thereabove to be singled next being grasped yet. In this embodiment the suction action travels a piece of the conveying path with the bank note, so to speak.

To increase the retaining force by retaining device 13, suction area 41 can also be disposed in retaining element 13.

As shown in FIG. 4, suction area 41 is provided between the two inner retaining runners 15*a*. While suction force only occurs on belt 4 when holes 40 are running across suction box 11, suction force is permanently effective on retaining element 13 since no control elements for the suction action or interruption are provided here.

The suction action through suction area 41 in retaining element 13 improves the retaining effect on the bank notes so that the clamping forces at clamping point 32 and thus the frictional stress on the bank note can be reduced. This clearly spares the bank notes during singling.

Adhesion between the bank notes to be singled and conveyer belt 4 can also be increased by compressed air action through a pressure area (not shown) disposed after clamping point 32 in the singling direction.

What is claimed is:

1. An apparatus having a feed device (4) for singling sheetlike data carriers from a stack (30) positioned on a rest (5), the feed device (4) and rest (5) being movable relative to each other in a clocked motion such that individual data carriers are moved in the direction of a singling gap having a variable width, and the width of the singling gap being delimited by a retaining device and the feed device (4), wherein adjustment of the width of the singling gap is variably synchronized with the clocked motion of the feed device and the rest.

2. An apparatus according to claim 1, characterized in that the retaining device (13) is controlled in accordance with the motion of the rest (5) for changing the width of the singling gap.

3. An apparatus according to claim 1, characterized in that the retaining device (13) can be acted upon directly by the rest (5).

4. An apparatus according to claim 1, characterized in that the retaining device (15*a*) and the feed device (4) have profiles which mesh with each other.

5. An apparatus according to claim 1, characterized in that the motion of the rest (5) is a lifting and/or swivel motion.

6. An apparatus according to claim 5, characterized in that the swivel motion of the rest (5) is effected around a pivot located on the side of the singling gap opposite the stack (30).

7. An apparatus according to claim 1, characterized in that the retaining device (13) has at least one clamping element (15) for producing a normal force on the data carriers.

8. An apparatus according to claim 7, characterized in that the rest (5) serves as a support for the normal force produced by the clamping element (15) on the opposite side of the data carrier.

9. An apparatus according to claim 1, characterized in that the retaining device (13) is acted upon by a biasing element in the direction of the feed device (4).

10. An apparatus according to claim 1, characterized in that the rest (5) is inclined toward the singling gap relative to the conveying direction of the feed device (4).

11. An apparatus according to claim 1, characterized in that the feed device (4) is provided with at least one suction area for subjecting the adjacent data carrier to a vacuum.

12. An apparatus according to claim 11, characterized in that the feed device (4) is a conveyer belt partly provided with at least one hole pattern.

13. An apparatus according to claim 11, characterized in that the feed device is a conveyer belt with a perforation extending over the total belt length and the conveyer belt cooperates with a suction chamber (11) whose vacuum is controllable.

14. An apparatus according to claim 13, characterized in that the suction area comprises two suction chambers (11), the vacuum of each suction chamber being controllable.

15. An apparatus according to claim 14, characterized in that one suction chamber is provided before the singling gap in the transport direction and the other suction chamber therebehind.

16. An apparatus according to claim 1, characterized in that the retaining device (13) has a pressure roll (17) preceding the singling gap.

17. An apparatus according to claim 1, characterized in that the retaining device (13) has a suction area (41) for acting upon the adjacent data carrier.

18. An apparatus according to claim 1, characterized in that a sensor (2) is provided after the singling gap in the singling direction for detecting the distance between two singled data carriers, its output signal being used to maintain predetermined distances of the control of the singling apparatus.

19. A method for singling sheetlike data carriers from a stack (30) located on a rest (5) with a feed device (4), wherein the feed device (4) and rest (5) are movable relative to each other in clocked fashion such that individual data carriers are moved in the direction of a singling gap limited by a retaining device and the feed device (4), and wherein in a first step a) the stack (30) is deposited on the rest (5), characterized by the following further method steps:

b) moving the rest (5) and a feed device (4) toward each other so that the data carrier acted upon directly by the feed device (4) is moved at least partly through the singling gap limited by the retaining device (13) and the feed device (4), simultaneously closing the singling gap so that the next data carrier is retained at the singling gap, c) moving the rest (5) and feed device (4) apart and ending or at least reducing the action of the feed device (4) on the stack (30) and opening the singling gap, d) repeating steps b) and c).

20. A method according to claim 19, characterized in that the data carrier is acted upon by a retaining force at the time when the moving apart of rest (5) and feed device (4) is ended.

21. A method according to claim 20, characterized in that the retaining force is continuously adjusted.

* * * * *